United States Patent [19]

Mori

[11] Patent Number: 4,799,086

[45] Date of Patent: Jan. 17, 1989

[54] TONER LAYER FORMING DEVICE

[75] Inventor: Ikuo Mori, Saitama, Japan

[73] Assignee: Fuji Xerox Co., Ltd., Tokyo, Japan

[21] Appl. No.: 14,254

[22] Filed: Feb. 11, 1987

[30] Foreign Application Priority Data

Feb. 19, 1986 [JP] Japan ..... 61-32819

[51] Int. Cl.[4] ..... G03G 15/09

[52] U.S. Cl. ..... 355/3 DD; 118/657

[58] Field of Search ..... 355/3 DD, 4; 118/653, 118/656, 657, 658

[56] References Cited

U.S. PATENT DOCUMENTS

| | | | |
|---|---|---|---|
| 4,538,898 | 9/1985 | Kanno et al. | 355/3 DD |
| 4,564,285 | 1/1986 | Yasuda et al. | 355/3 DD |
| 4,624,545 | 11/1986 | Yasuda et al. | 355/3 DD |
| 4,662,311 | 5/1987 | Shoji et al. | 118/658 X |

FOREIGN PATENT DOCUMENTS 59-29873 7/1984 Japan .

59-33916 8/1984 Japan .

*Primary Examiner*—Fred L. Braun

*Attorney, Agent, or Firm*—Finnegan, Henderson, Farabow, Garrett, & Dunner

[57] ABSTRACT

A toner layer forming device for an electrostatic image reproduction machine having a photosensitive latent image carrier includes a fixed magnet including a plurality of spaced poles of opposite polarity; a non-magnetic sleeve including a developing surface rotatable about the magnet for carrying a thin layer of toner particles and for transferring a portion of the layer to the carrier; a toner supply device for supplying a layer of toner particles onto the surface of the sleeve; a pretrimmer for reducing the thickness of the layer of toner supplied to the sleeve by the supply device upon rotation of the sleeve; and a restriction member braced against the surface of the sleeve for frictionally charging the toner particles on the surface, and for further reducing the thickness of the toner layer to a predetermined value for transfer to the carrier.

14 Claims, 3 Drawing Sheets

TONER LAYER FORMING DEVICE

BACKGROUND OF THE INVENTION

The present invention generally relates to a developing device which uses a magnetic one-component toner, and particularly relates to a toner layer forming device for forming a thin layer of a magnetic one-component toner on a developing sleeve.

In classifying developing methods for developing an electrostatically charged pattern in view of a composition of a developer, there is a two-component developing method and a one-component developing method. In the two-component developing method, the developer is composed of a mixture of carrier particles, such as iron powder or glass-beads etc., and toner particles which are used to actually develop an electrostatic latent image. The two-component developing method has disadvantages such as fluctuation in image density caused by variations in mixture ratio between the carrier particles and the toner particles, and reduction in image quality owing to deterioration of the carrier particles.

By contrast, the one-component developing method uses no carrier particles and therefore the foregoing disadvantages of the two-component developing method are not encountered. As a result, mono-component developers have a bright future for use in developing methods. The one-component developers used in the one-component developing method are roughly classified into nonmagnetic one-component developers and magnetic one-component developers. The magnetic one-component developer includes magnetic powder in the toner particles, because of the necessity of means for carrying the developer to the developing region facing an electrostatic image.

In a conventional magnetic one-component developing method, a nonmagnetic bartrimmer faces a developing sleeve so as to form a thin layer of the toner particles on the developing sleeve while rubbing the toner particles to thereby charge the toner particles with triboelectricity. Thus, a toner image corresponding to the electrostatic latent image on a photosensitive drum is formed on the photosensitive drum when the thin layer of the toner particles comes into opposition to the photosensitive drum.

In the conventional developing device using a magnetic one-component toner, however, it is difficult to form a uniform thin layer of toner particles in the axial direction of the developing sleeve, and toner particles may be sandwiched between the developing sleeve and the nonmagnetic bartrimmer, and are apt to cause poor formation of the thin layer of the toner particles at that portion.

In a toner layer forming method using a magnetic bartrimmer (for example, the methods described in Japanese Patent Publication Nos. 33916/84 and 29873/84), sufficient charge property cannot be obtained in the case of some kinds of developers, so that high picture quality is not always attained.

Further, in a developing device using an apron blade 4 as shown in FIG. 5, the apron blade 4 is rubbed by a developing sleeve 3, so that excessive friction may occur on the developing sleeve 3 or the like. As a result, toner particles may become unevenly charged. In this developing device, there is a further problem that the developing sleeve 3 and the apron blade 4 are arranged in the form of a wedge upstream of the apron blade 4, so that the toner particles may adhere to the wedge-shaped portion.

SUMMARY OF THE INVENTION

Accordingly, an object of the invention is to provide a toner layer forming device in which a thin layer of uniformly charged toner particles can be consistently formed on a developing sleeve without causing coherence of the toner particles.

It is another object of the invention to reduce noise caused by friction in an electrostatic image device.

Another object of the invention is to increase the useful life of a layer forming restriction member in an image reproduction device.

Still another object of the invention is to reduce the drive torque required for rotating the developing sleeve in an image processing device.

To achieve the foregoing objects and advantages, the toner layer forming device of the present invention comprises fixed magnetic means including a plurality of spaced poles of opposite polarity; non-magnetic sleeve means including a developing surface rotatable about the magnetic means for carrying a thin layer of toner particles and for transferring a portion of the layer to the image carrier of the reproduction machine; toner supply means for supplying a layer of toner particles onto the surface of the sleeve means; pretrimming means for reducing the thickness of the layer of toner supplied to the sleeve means by the supply means upon rotation of the sleeve means; and restriction member means braced against the surface of the sleeve means for frictionally charging the toner particles on the surface, and for further reducing the thickness of the toner layer to a predetermined value for transfer to the carrier.

It is preferred that the pretrimming means include a magnetic member mounted substantially opposite to one pole of the fixed magnetic means. The magnetic member may include a magnetic blade having an angled forward face and a substantially flat rear face, the angle between the rear face and a line parallel to the forward face being between about 0° and 90°. Preferably the angle is about 90°.

It is preferred that the magnetic blade have a thickness of about 0.01 to 0.50 mm, and more preferably about 0.05 to 0.15 mm.

It is also preferred that the one pole have a width of about 5 to 20 mm, and more preferably about 7 to 15 mm.

It is preferred that the restriction member means include a friction member positioned downstream from the pretrimming means for contact with the surface at a point within the width of the pole of the one magnet. The friction member preferably includes a material selected from the group consisting of silicone rubber, fluoro rubber, EPDM and polyurethane rubber. The friction member also may be mounted to the pretrimming means.

Preferably, the surface is polished and has a surface roughness of less than about 2 m.

BRIEF DESCRIPTION OF THE DRAWINGS

The accompanying drawings, which are incorporated in and constitute a part of the specification, illustrate an embodiment of the invention, and together with the description, serve to explain the principles of the invention.

Of the drawings.

DETAILED DESCRIPTION OF THE PREFERRED EMBODIMENT

Reference will now be made in detail to the present preferred embodiment of the invention, an example of which is illustrated in the accompanying drawings.

In accordance with the invention, the toner layer forming device is for an electrostatic image reproduction machine having a photosensitive latent image carrier. The invention comprises fixed magnetic means including a plurality of spaced poles of opposite polarity; non-magnetic sleeve means including a developing surface rotatable about the magnetic means for carrying a thin layer of toner particles and for transferring a portion of the layer to the carrier; toner supply means for supplying a layer of toner particles onto the surface of the sleeve means; pretrimming means for reducing the thickness of the layer of toner supplied to the sleeve means by the supply means upon rotation of the sleeve means; and restriction member means braced against the surface of the sleeve means for frictionally charging the toner particles on the surface, and for further reducing the thickness of the toner layer to a predetermined value for transfer to the carrier.

Figure 3:
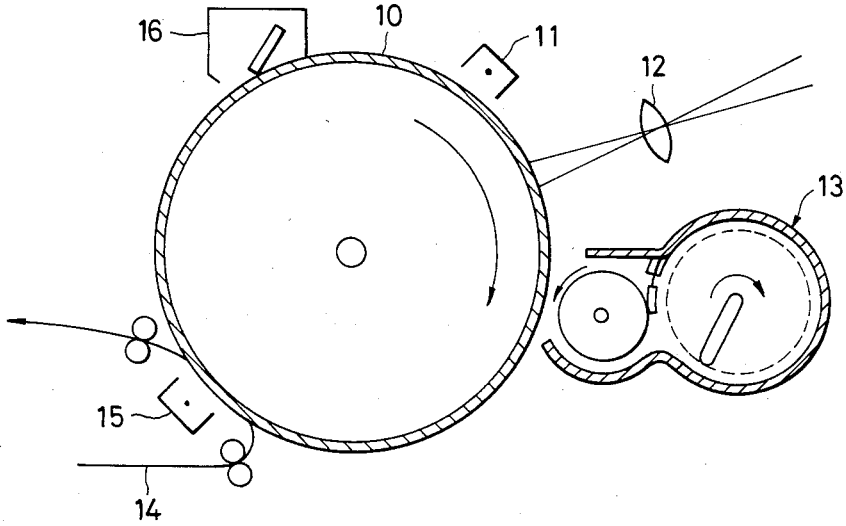
FIG. 3 is a schematic constituent view showing a copying machine to which the toner forming device of FIG. 1 is applied.

FIG. 3 shows an embodiment of a copying machine to which a toner forming device of the present invention is applied.

As embodied herein, a photosensitive drum 10 is uniformly electrically charged by a charging corotron 11 for acting as an electrostatic latent image carrier. The drum 10 is irradiated with reflection light rays from an original document (not shown) through an optical lens 12, so that an electrostatic latent image corresponding to the original document is formed on the photosensitive drum by the reflection light rays. Toner particles adhere onto the electrostatic latent image to develop the image by a one-component developing device 13 to render the electrostatic latent image visible. The visible image is transferred by a transfer corotron 15 onto a paper sheet supplied from a sheet transporting path 14 at a transfer section provided downstream in the rotating direction of the photosensitive drum. The sheet carrying the transferred image is transmitted to a fixing device (not shown) in which the transferred image is fixed, and the sheet is discharged into sheet tray (not shown).

Figure 1A:
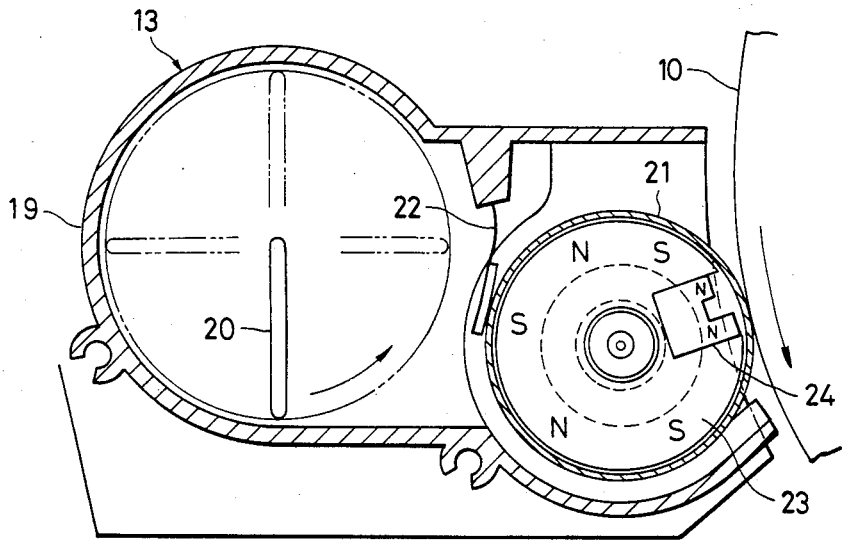
FIG. 1A is a schematic cross-section showing an embodiment of the present invention.
Figure 1B:
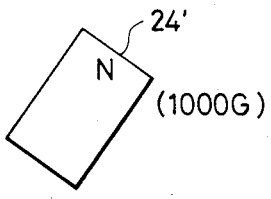
FIG. 1B is a magnet utilized in the present invention.

The one-component developing device 13 is arranged such that, as shown in FIG. 1, magnetic one-component toner particles are supplied to a nonmagnetic cylindrical developing sleeve 21 by a rotor 20 accommodated within a housing 19 for acting as toner supply means. The toner particles are frictionally charged by an elastic magnetic blade 22 so as to form a thin uniform toner layer on the developing sleeve 21. A part of the thin toner layer formed on the developing sleeve 21 adheres onto the photosensitive drum 10 in a pattern corresponding to the electrostatic latent image at a developing position opposite to the photosensitive drum 10, so as to make the latent image visible. A fixed cylindrical magnet 23 having a plurality of N and S poles alternately disposed as shown in the drawing is mounted inside the developing sleeve 21. A magnet 24 having N poles (500G, 1000G) at its opposite sides is mounted inside the developing sleeve 21 at a position facing the photosensitive drum 10. A magnet 24' having N pole (1000G) also could be used as shown in FIG. 1B.

Figure 2:
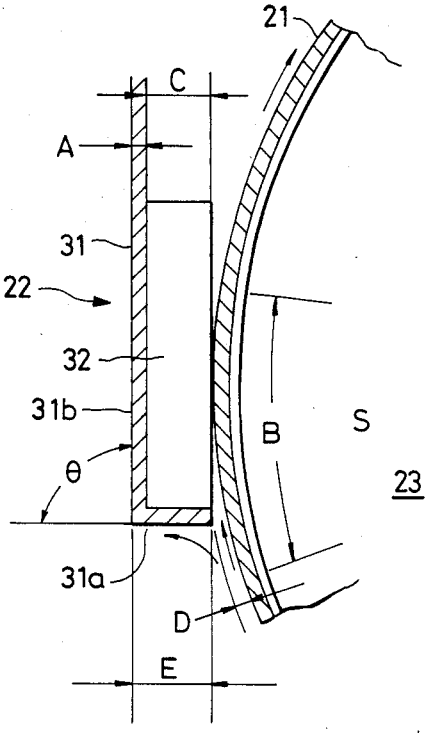
FIG. 2 is a schematic cross-section showing the main portion of the FIG. 1.

As shown in FIG. 2, the elastic magnetic blade 22 for forming a thin toner layer on the developing sleeve 21 includes a polymer 32 made of a resin material such as silicone rubber, fluoro rubber, EPDM, polyurethane rubber, or the like, (silicone rubber of hardness 50 is used in this embodiment), and a magnetic member 31 for holding the polymer member 32. The forward end portion of the magnetic member 31 is bent toward the developing sleeve 21 to form an angled portion **31*a* with a bent angle which falls within a predetermined range with respect to a base portion 31*b***. The range of the bent angle is selected to be 30–90 degrees, and preferably the angle is set to be about 90 degrees.

The elastic force of the magnetic member 31 of the elastic magnetic blade 22 causes the magnetic polymer member 32 to abut against the surface of the developing sleeve 21 substantially facing the S pole of the fixed cylindrical magnet 23. As the developing sleeve 21 rotates clockwise, the thickness of the magnetic one-component toner layer formed on the surface of the developing sleeve 21 is defined to be about a half of the gap distance D between the sleeve 21 and the forward end of the bent portion **31*a* by the action of a magnetic field between the bent portion 31*a* of the magnetic member 31 and the S pole of the fixed cylindrical magnet 23. This action is referred to as pretrimming. Then, the layer of magnetic one-component toner particles are frictionally charged uniformly by the frictional contact between the developing sleeve 21 and the downstream positioned polymer member 32. At the same time, the thickness of the layer of toner particles is reduced to a predetermined value by the urging force exerted onto the sleeve 21 by the polymer member 32**.

In this case, the relationship between the thickness A of the magnetic member 31 and the pole width B at the magnetic pole S of the fixed cylindrical magnet 23 is selected such that $A \leqq B$, and that the bent portion **31*a* and a contact portion between the polymer member 32 and the developing sleeve 21 are positioned in a range included within the pole width B. The numerical value of the thickness A of the magnetic member 31 is set preferably within a range of 0.01–0.50 mm, and more preferably within a range of 0.05–0.15 mm. The numerical value of the pole width B of the fixed cylindrical magnetic 23** is set preferably within a range of 5–20 mm, and more preferably within a range of 7–15 mm. Within the above-mentioned ranges a thin and uniform layer of magnetic one-component toner particles can be formed consistently.

The numerical value of the thickness C of the polymer member 32 is specifically selected in view of the purposes of the polymer member 32 to make the thin layer of one-component toner particles uniform, to act as an assistant for charging the toner particles and to keep the layer stably. Because charge-assisting is one of the actions of the polymer member 32, the urging force of the polymer member 32 against the developing sleeve 21 should be small enough to prevent the polymer member 32 from being worn out, and to thereby prolong the life of the polymer member. The thickness C of the polymer member 32 helps to keep the gap between the magnetic member 31 and the developing sleeve 21 at a predetermined distance. The thickness C is set at a predetermined value (1.3 mm in this embodiment) which will form a desired thin toner layer while considering the effect on the toner by the action of magnetic field formed between the magnetic member 31 and the S pole portion of the fixed cylindrical magnet 23.

The numerical value of the gap distance D between the developing sleeve 21 and the forward end of the bent portion 31*a* of the magnetic member 31 is specifically determined (0.7 mm in this embodiment) on the basis of the mutual relation among the bent length E at the forward end of the magnetic member 31, the radius of curvature of the developing sleeve 21, and the touching position between the polymer member 32 and the developing sleeve 21. That is, the numerical value of D is selected so as to form a predetermined toner layer thickness with respect to the numerical value of the bent angle $\theta$ of the bent portion 31*a* which forms a thin toner layer on the developing sleeve 21.

A polished sleeve (having surface roughness $Rz<2$ $\mu$m) is preferably used as the sleeve, because it is superior in charging characteristics in comparison with a blasting-processed sleeve. This makes it possible to form a more uniform thin layer of toner particles. After the amount of toner particles has been reduced by the above-mentioned pretrimming the toner layer is pressed between the polymer member 32 and the sleeve 21 for charging under a uniform pressing force. Thus, the particles are uniformly and sufficiently charged while rolling on the sleeve, since the surface of the sleeve is smooth and the urging force exerted onto the toner particles is considerably small (for example, 50 g/cm$_2$). Polished and blasting-processed sleeves of precipitation hardening stainless steel each having a diameter of 36 mm were prepared and experiments were performed with three combinations, including the present invention. In particular, the tests were done with a combination of the toner layer thickness restriction device according to the present invention and a polished sleeve, another combination of the toner layer thickness restriction device according to the present invention and a blasting-processed sleeve ($Rz\approx5.5$ $\mu$m), and a further combination of a magnetic bartrimmer and a polished sleeve. The best toner charging polarity distribution as well as the best tolerance for smears in the background relative to the bias electric potential was achieved with the invention combined with a polished sleeve. The combination with the blast - processed sleeve was the next best in both categories. Further, bias leakage as well as adherence of toner particles onto the sleeve were decreased because of the surface smoothness of the polished sleeve. Furthermore, the polymer member does not wear out as quickly, thereby prolonging the life of that member.

The mutual arrangement of S and N magnetic poles of the fixed cylindrical magnet 23, according to the present invention, is not limited to that shown in FIGS. 1 and 2 in this embodiment. If the S and N poles are alternatively arranged from the positions shown in FIGS. 1 and 2, the setting of the polarity of the respective magnetic poles may be rearranged.

Figure 4:
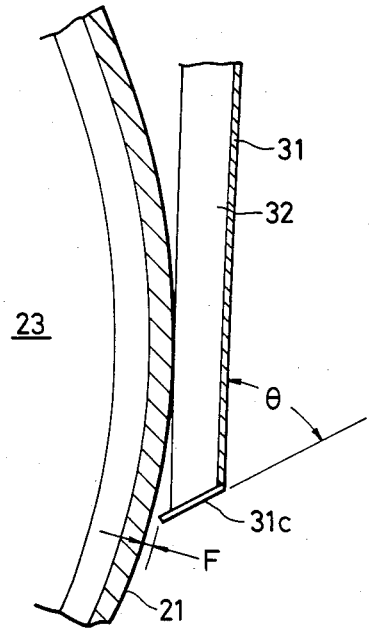
FIG. 4 is a schematic cross-section showing the main portion of another embodiment of the present invention.
Figure 5:
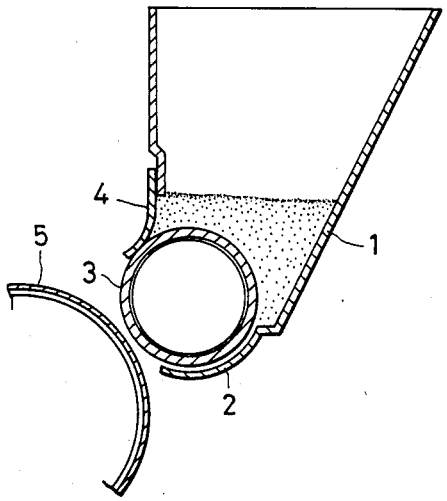
FIG. 5 PRIOR ART
FIG. 5 is a schematic constituent view showing a conventional toner forming device.

FIG. 4 shows another embodiment according to the present invention, in which the bent angle $\theta$ at the bent portion 31*c* on the forward end of a magnetic member 31 is selected to be about 60 degrees. One of the aims of this embodiment is to improve the flow of toner particles which adhere on the developing sleeve 21 when they touch the bent portion 31c. The size of the gap F between the bent portion 31c and the developing sleeve 21 is selected at a predetermined value so as to form a thin layer of toner particles having a predetermined thickness and charged uniformly on the developing sleeve 21, similar to the foregoing embodiment shown in FIG. 2.

The main function of the magnetic portion 31 in each of the foregoing embodiments is to give the polymer member 32 uniform urging force against the sleeve 21. Accordingly, the magnetic member 31 may be replaced by any other elastic member made of various kinds of plastic, or the like, other than metal such as stainless steel, or the like. In this case, the magnetic member corresponding to the bent portion 31*c* should be attached at or in the vicinity of the forward end of the elastic member.

According to the present invention, the thickness of a layer of magnetic one-component toner particles formed on a developing sleeve is restricted to a predetermined value by a pretrimming operation of a magnetic member provided at the forward end of the toner layer thickness restriction member. The layer of toner particles touches a resin member at a position downstream from the toner layer thickness restriction member so that the developing sleeve and the magnetic one-component toner particles are subject to triboelectrification to give a sufficient charge for development to the magnetic one-component toner particles. At the same time those magnetic one-component toner particles can be formed into a uniform and stable thin layer. Accordingly, when the electrostatic latent image on an electrostatic latent image carrier is developed by a part of the thin layer of toner particles, it is possible to obtain a more clear and consistent developed image.

Since the urging force between the toner layer thickness restriction member and the sleeve can be reduced, as described above, inconveniences such as abrasion of the thickness restriction member and the sleeve, adherence of toner particles, and so on, can be avoided, noises caused by friction are reduced, required driving torque is reduced, and bending of the sleeve, which causes a problem in wide width developing, can be reduced.

According to the present invention, as a developing sleeve rotates, the thickness of the layer of magnetic one-component toner particles on the developing sleeve is pretrimmed by magnetic action between a magnetic member and a fixed magnet, and then the magnetic one-component toner particles are formed into a thin layer of a predetermined thickness at a portion where a toner layer thickness restriction member is urged against the sleeve. At the same time, the toner particles are supplied with necessary charges for development by triboelectricity caused when the magnetic one-component toner particles contact a resin material. Thus, a uniform thin layer of toner particles is formed on the developing sleeve.

Various modifications and variations could be made in the invention without departing from the scope or spirit of the invention.

What is claimed is:

1. A toner layer forming device for an electrostatic image reproduction machine having a photosensitive latent image carrier, comprising:

fixed magnetic means including a plurality of spaced poles of opposite polarity;

non-magnetic sleeve means including a developing surface rotatable about the magnetic means for carrying a thin layer of toner particles and for transferring a portion of the layer to the carrier;

toner supply means for supplying a layer of toner particles onto the surface of the sleeve means;

pretrimming means for reducing the thickness of the layer of toner supplied to the sleeve means by the supply means upon rotation of the sleeve means, said layer of toner being reduced by said pretrimming means to a first selected thickness; and restriction member means braced against the surface of the sleeve means for frictionally charging the toner particles on the surface, and for further reducing the thickness of the toner layer to a second selected thickness of predetermined value less than said first selected thickness for transfer to the carrier.

2. The device of claim 1 wherein the surface is polished and has a surface roughness of less than about 2 μm.

3. The device of claim 1 wherein the surface is blast-processed.

4. The device of claim 1, wherein the restriction member means is positioned adjacent to and downstream of the pretrimming means.

5. The toner layer forming device of claim 1 wherein the pretrimming means includes a magnetic member mounted substantially opposite to one pole of the fixed magnetic means.

6. The device of claim 5 wherein the restriction member means includes a friction member positioned downstream from the pretrimming means for contact with the surface at a point within the width of the pole of the one magnet.

7. The device of claim 6 wherein the friction member includes a material selected from the group consisting of silicone rubber, fluoro rubber, EPDM and polyurethane rubber.

8. The device of claim 7 wherein the friction member includes a resin material, and wherein the friction member is mounted to the pretrimming means.

9. The toner layer forming device of claim 5 wherein the magnetic member includes a magnetic blade having an angled forward face and a substantially flat rear face, the angle between the rear face and a line parallel to the forward face being between about 0° and 90°.

10. The device of claim 9 wherein the angle is about 90°.

11. The device of claim 10 wherein the magnetic blade has a thickness of about 0.01 to 0.50 mm.

12. The device of claim 11 wherein the thickness of the magnetic blade is about 0.05 to 0.15 mm.

13. The device of claim 9 wherein the one pole has a width of about 5 to 20 mm.

14. The device of claim 13 wherein the width of the one pole is about 7 to 15 mm.

* * * * *